US008827767B2

(12) United States Patent
Samoodi

(10) Patent No.: US 8,827,767 B2
(45) Date of Patent: Sep. 9, 2014

(54) SUPPORTIVE POSTURE-ENHANCING GARMENTS

(75) Inventor: Leila Samoodi, Irvine, CA (US)

(73) Assignee: House of Layla, Inc., Irvine, CA (US)

( * ) Notice: Subject to any disclaimer, the term of this patent is extended or adjusted under 35 U.S.C. 154(b) by 239 days.

(21) Appl. No.: 13/424,641

(22) Filed: Mar. 20, 2012

(65) Prior Publication Data

US 2013/0253397 A1 Sep. 26, 2013

(51) Int. Cl.
*A41C 1/08* (2006.01)

(52) U.S. Cl.
USPC ..... 450/155; 450/19; 450/20

(58) Field of Classification Search
USPC ..... 450/2, 7, 8, 19–22, 155; 66/170, 171, 66/172 E, 175, 176; 2/69, 78.1–78.4, 73
See application file for complete search history.

(56) References Cited

U.S. PATENT DOCUMENTS 1,718,772 A * 6/1929 Barcley ..... 450/121
1,769,364 A * 7/1930 Barcley ..... 450/125
1,889,285 A * 11/1932 Hart ..... 450/9
2,023,701 A * 12/1935 Rosenfeld ..... 450/8
4,789,372 A * 12/1988 Wicks ..... 450/155
5,737,772 A * 4/1998 Dicker et al. ..... 2/69
5,915,531 A * 6/1999 Hilpert et al. ..... 2/69
5,978,966 A 11/1999 Dicker et al.
6,047,406 A 4/2000 Dicker et al.
7,637,884 B2 * 12/2009 Nordt et al. ..... 602/60
7,871,388 B2 1/2011 Brown
8,113,911 B1 2/2012 Hansen et al.
2009/0062704 A1 3/2009 Brown et al.
2009/0270012 A1 * 10/2009 Melarti et al. ..... 450/8

* cited by examiner

*Primary Examiner* — Gloria Hale
(74) *Attorney, Agent, or Firm* — Hoffmann & Baron, LLP

(57) ABSTRACT

Supportive garments, particularly maternity and post-maternity garments, are provided for support and promoting good posture of a wearer. The garment covers a wearer's torso and at least an upper portion of a wearer's thighs and includes a non-stretchable posterior panel positioned to extend transversely at least over an inter scapular upper back region of a wearer and longitudinally to a wearer's waistline, and connecting across a stretchable body portion that covers a lower torso and extends along a wearer's posterior sides to a shoulder region. An embodiment suitable as a maternity garment includes an abdominal portion having a more stretchable material than surrounding areas, whereas an abdominal portion in another embodiment suitable for post-maternity or slimming supportive wear is more compressive and incorporates cellulite-reducing fibers. A shoulder support portion extends laterally and upwardly from a lower portion of the posterior panel to the shoulder region.

16 Claims, 6 Drawing Sheets

SUPPORTIVE POSTURE-ENHANCING GARMENTS

FIELD OF INVENTION

This invention relates generally to supportive and posture-enhancing garments and their methods of manufacture. More particularly, in certain embodiments, the invention relates to maternity and post-maternity undergarments with these features.

BACKGROUND OF THE INVENTION

Pregnancy exerts a particular physical toll on a woman's body due to the demands of the growing fetus. Naturally, the abdominal muscles and pelvic ligaments and joints are strained. The added weight of the growing fetus also naturally shifts the mother's center of gravity causing a disruption in posture and balance, causing pain to the lower back and other parts of the body. Muscle spasms are also a natural consequence. In addition, stress is placed on the spinal cord as the body tries to compensate for the added weight of the fetus and maintain balance throughout the pregnancy. This stress on the spinal cord can be the source of back, neck, and shoulder pain as well as headaches. The fetus can also place pressure on the lungs especially in the third trimester. In addition, there is increased stress on the circulatory system due to the increase in body fluids and blood supply, which can result in problems in circulation as well as conditions such as edema.

Supportive undergarments currently available to pregnant women are directed primarily to support and compression under the belly and are targeted primarily to reducing lower back pain. Typically, such garments are either singularly compressive, or have two zones of compression, the higher compressive bands being positioned under the belly.

For example, maternity bands and belts are targeted to provide lift support to the belly and to thereby also reduce strain on the lower back by adding a compression band under the belly. Tummy tubes provide similar support as well as compression across the belly and can be used as a post-partum garment as well. Tank tops are also available that extend the compression band to the shoulders for added lift by criss-crossing along the back, while providing less compression to the area over the belly. Similarly, a maternity panty is known that provides more compression under the belly and around the lower back than across the belly, optionally extending to a mid-thigh area as well.

U.S. Pat. No. 8,113,911 to Hansen et al. discloses a maternity body support having a lightweight body shell with a front abdominal opening. The '911 patent discloses that the body support can work to correct a woman's posture during pregnancy by anchoring each of the wearer's shoulder to the opposite pelvis through a complex system of anchors located adjacent each shoulder and pelvis and criss-crossing adjustable straps fixed diagonally thereto.

In addition, though posture improvement shirts are known, these garments only address alignment of the upper back through nerve stimulation. They are not effective for addressing alignment along the entire spinal column, or for relief of pain and discomfort to the neck, shoulders, and upper and lower spine. For example, U.S. Ser. No. 12/126,338, filed on May 23, 2008, and published as US Pub. No. 2009-0062704 by Brown et al. on Mar. 5, 2009 discloses posture improvement shirts adapted to improve the user's body alignment of posture through the use of neuromuscular stimulation. Brown discloses a proprioceptive panel extending over the upper back or inter scapula region of the wearer. The panel can be comprised of a heavier material than the surrounding material. Brown discloses that nerve receptor stimulators, such as "neuro-nubs," can be disposed on an inner surface of the shirt and can be located at known acupuncture sites. Brown does not disclose a body suit for maternity or post-maternity wear.

While some of the garments described above may help to alleviate lower back pain, neither the maternity garments nor the posture-stimulating shirt disclosed by Brown are adapted to alleviate pain and discomfort to the neck, spine, and shoulders, particularly in the case where the wearer is a pregnant woman. In this case, the strain on the entire spinal column, as well as on the neck and shoulders need to be addressed. Furthermore, the system of the '911 patent is bulky and unsuitable for use as a formfitting undergarment. Accordingly, there is a need in the art to provide undergarments to address and alleviate pain and discomfort in the neck, spine, and shoulders, as well as in the lower back of a wearer. There is also a need to provide an undergarment with the same benefits which can be worn by a pregnant woman, and which can additionally help alleviate the additional effects caused by stress and strain on the lungs and circulatory system.

SUMMARY

The invention relates to garments, particularly those suited for, but not limited to, maternity and post-maternity wear, having multiple zones of compression as well as non-stretchable zones positioned to cooperate to stabilize a wearer's posture and to provide needed support and compression where needed.

In one aspect of the present disclosure, a garment includes a form-fitting structure adapted to cover a wearer's torso and at least an upper portion of a wearer's thighs and includes a posterior region for extending across a wearer's back, and an anterior region for covering a wearer's breasts and abdomen, a left and right lateral region bordering the anterior and posterior regions on a wearer's left and right side respectively, and a shoulder region positioned to extend over each shoulder of a wearer and bordering two armholes for fitting a wearer's arms. A posterior panel is disposed in the posterior region, the posterior panel comprising a first non-stretchable material and positioned to extend transversely at least over an inter scapular upper back region of a wearer and longitudinally to at least a wearer's waistline. An abdominal portion is centrally disposed in the anterior region, the abdominal portion comprising a stretchable material having a level of compression different than that of a material disposed in the anterior region encircling the abdominal portion. A shoulder support portion extends laterally and upwardly from a lower portion of the posterior panel to the shoulder region above each of the two armholes, the shoulder support portion also wrapping laterally around each of the left and right lateral region and extending under each axilla of a wearer.

In one aspect, the garment further includes two patches formed of a highly compressive material positioned in the left and right lateral region along a left and right side of a wearer's waist.

In another aspect, the posterior panel of the garment includes a central posterior panel and a pair of posterior lateral panels disposed in the posterior region, each of the pair of posterior lateral panels extending laterally and upwardly from an upper portion of the central posterior panel to the shoulder region above each of the two armholes superior to the shoulder support portion. The pair of posterior lateral panels comprise a second non-stretchable material, which can be the same material.

In another aspect, each of the two patches is substantially oval shaped and with a maximum width, and extends longitudinally a length proximate an inferior edge of a wearer's ribcage downward to a wearer's hip, where the length is equal to or greater than twice the maximum width.

In yet another aspect, the garment also includes a lower torso region extending transversely around a wearer's buttocks and lower abdomen and having two extending leg portions with openings for a wearer's legs and a body support portion. The body support portion is positioned to extend over the lower torso region and further along each of the left and right lateral sides to the shoulder region, the body support portion bordering and encircling the abdominal portion and comprising the material disposed in the anterior region encircling the abdominal portion. The posterior panel is operatively connected between an upper edge of the body support portion in the shoulder region and an upper edge of the body support portion in the posterior region.

In one aspect, which is particularly well-suited for use as a maternity garment, the level of compression of the stretchable material of the abdominal portion is less than that of the material disposed in the anterior region encircling the abdominal portion.

The garment can also include a band around a lower perimeter of each of the two extending leg portions for anchoring the body support portion.

In certain aspects, the body support portion is more compressive and resistant to stretching than the shoulder support portion, and the stretchable material of the abdominal portion is less resistant to stretching and less compressive than the material of the body support portion and of the shoulder support portion. In addition, the highly compressive material of the two lateral patches along a left and right side of a wearer's waist is preferably more compressive than the body support portion.

In other aspects, at least a portion of the garment comprises an inner surface for contacting a wearer's skin including at least one of a skin-toning, antimicrobial, and odor-reducing agent.

Another garment of the present disclosure, which is particularly well-suited for, but not limited to, use as a post-maternity garment, includes a form-fitting structure adapted to cover a wearer's torso and at least an upper portion of a wearer's thighs. The garment includes a posterior region for extending across a wearer's back, and an anterior region for covering a wearer's breasts and abdomen, a left and right lateral region bordering the anterior and posterior regions on a wearer's left and right side respectively, and a shoulder region positioned to extend over each shoulder of a wearer and bordering two armholes for fitting a wearer's arms. A posterior panel is disposed in the posterior region, the posterior panel comprising a first non-stretchable material and positioned to extend transversely at least over an inter scapular upper back region of a wearer and longitudinally to at least a wearer's waistline. An abdominal portion is centrally disposed in the anterior region, the abdominal portion comprising a stretchable material having a level of compression higher than that of a material disposed in the anterior region encircling the abdominal portion. A shoulder support portion extends laterally and upwardly from a lower portion of the posterior panel to the shoulder region above each of the two armholes, the shoulder support portion also wrapping laterally around each of the left and right lateral region and extending under each axilla of a wearer.

In one aspect, the garment also has a lower torso region extending transversely around a wearer's buttocks and lower abdomen and having two extending leg portions with openings for a wearer's legs. A body support portion is positioned to extend over the lower torso region and further extending along each of the left and right lateral sides to the shoulder region, the body support portion bordering and encircling the abdominal portion and comprising the material disposed in the anterior region encircling the abdominal portion. The posterior panel is operatively connected between an upper edge of the body support portion in the shoulder region and an upper edge of the body support portion in the posterior region. The level of compression of the stretchable material of the abdominal portion is higher than that of the material of the body support portion encircling the abdominal portion.

In another aspect, the garment further includes two patches formed of a highly compressive material positioned in the left and right lateral region along a left and right side of a wearer's waist, wherein the level of compression of the stretchable material of the abdominal portion and of the highly compressive material are greater than that of the body support portion, and wherein the body support portion is more compressive and resistant to stretching than the shoulder support portion.

In additional aspects of the garment, any portion of the garment, particularly, any one or more of the stretchable material of the abdominal portion, the material of the body portion, and the highly compressive material of the patches, can include an inner surface for contacting a wearer's skin comprising cellulite-reducing fibers. The cellulite-reducing fibers can include NILIT® nylon fibers.

DESCRIPTION OF EMBODIMENTS OF THE INVENTION

The following sections describe exemplary embodiments of the present invention. It should be apparent to those skilled in the art that the embodiments provided in the present disclosure are illustrative only and not limiting, having been presented by way of example only.

Throughout the description, where devices and systems are described as having, including, or comprising specific components, or where processes and methods are described as having, including, or comprising specific steps, it is contemplated that, additionally, there are devices and systems of the present invention that consist essentially of, or consist of, the recited components, and that there are processes and methods according to the present disclosure that consist essentially of, or consist of, the recited processing steps.

Figure 1:
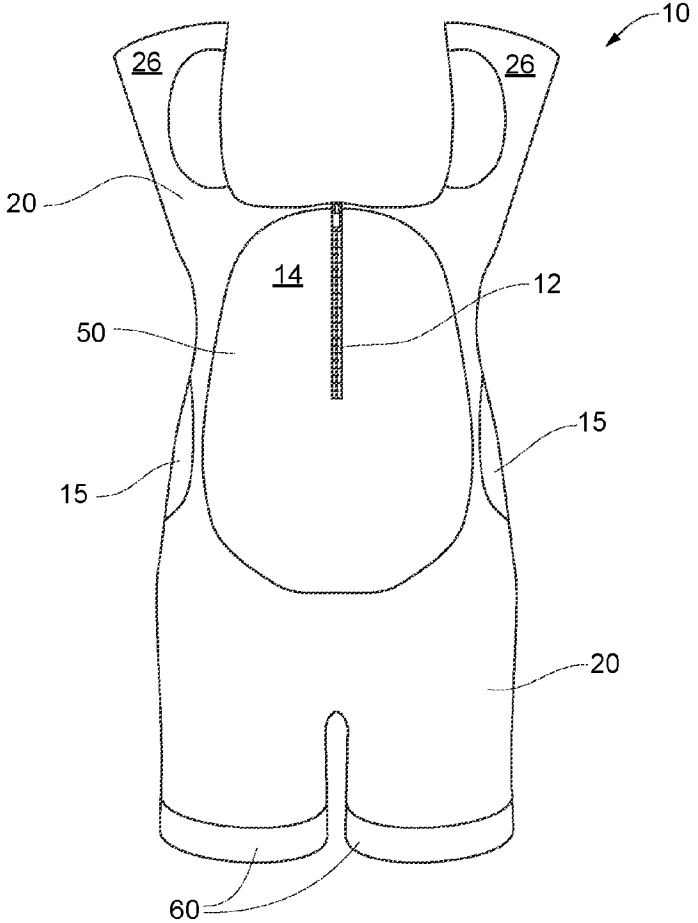
FIG. 1 is a front view of an embodiment of a garment of the present disclosure.

Referring to FIG. 1, a garment of the disclosure has the form of a full-length tanktop or t-shirt with integrated panties and/or shorts. Preferably, it is form-fitting, and is adapted to be pulled on over the legs like a unitard, bodysuit, or jumpsuit. Variations of the garment described and depicted herein are contemplated as additionally within the scope of the invention and include those that cover a front of the torso, including the abdomen and breasts, and those that cover the abdomen but do not fully cover the breasts. Though not shown, a zipper, button(s), snap(s), hook-and-eye, VELCRO® or other like closures can be included, preferably in the front of the garment, to aid in donning and removing the garment.

As will be described further below, certain embodiments of the garment of the present disclosure are particularly adapted for use as maternity and post-maternity wear. In these embodiments, additional variations which are within the scope of the invention include modifications to the front of the garment to provide access to the areolae to facilitate breast-feeding, and to accommodate the use of nursing pads in a post-maternity garment.

Figure 2:
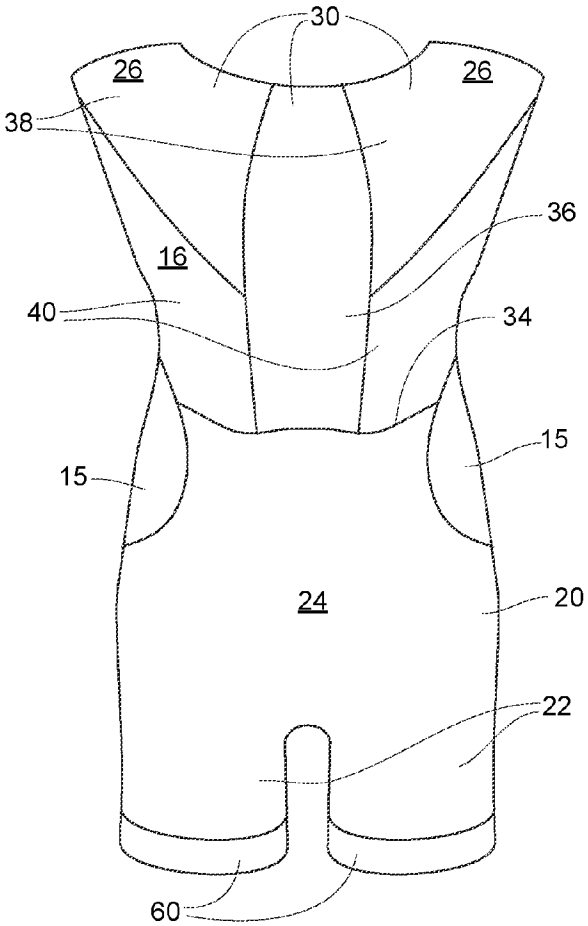
FIG. 2 is a rear view of the garment shown in FIG. 1.
Figure 3:
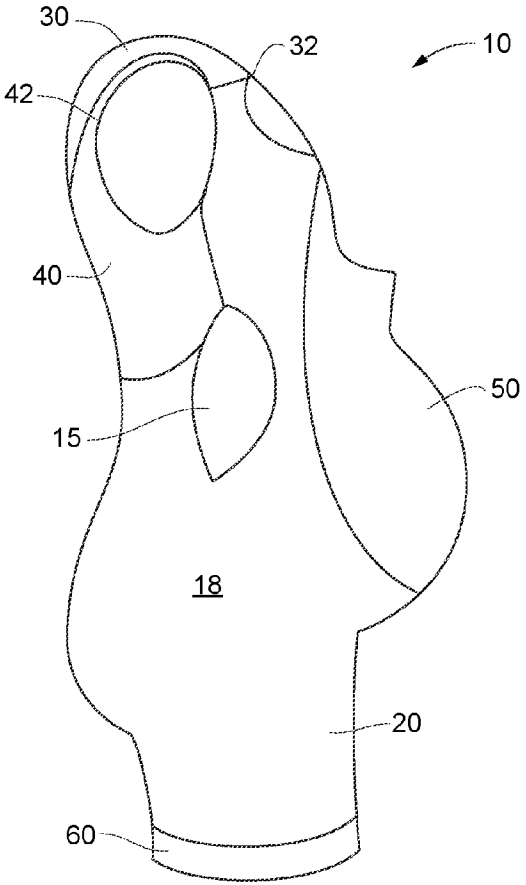
FIG. 3 is a side view of the garment shown in FIG. 1.

Referring to FIGS. 1-3, one embodiment 10 of a garment of the present disclosure contemplated for use as a maternity bodysuit includes multiple zones functionally designed and strategically positioned on a pregnant woman's body to induce a neutral posture and support for a growing fetus. The different zones can have different levels and directions of stretch, compression, and/or nerve stimulation.

The embodiment 10 shown is a mid-thigh tank design extending from the neck and shoulders to the mid-thigh of a wearer, and covering the breasts and abdomen of a wearer. Referring to FIG. 1, a zipper 12 can be included for ease in donning and removing the garment, preferably in an anterior region 14, or front, of the garment and extending at least from a middle of a wearer's abdomen to a top edge of the garment. One of skill in the art will appreciate that numerous variations of the design of embodiment 10 are possible without departing from the scope of the present invention.

The garment 10 can include a first zone 15 that provides a high level of compression in the waist area of a wearer's body. In one embodiment, first zone 15 is adapted to provide the greatest compression to a wearer than any other area of the garment 10. Referring also to FIG. 2, which shows a posterior region 16 of the garment, and to FIG. 3, which shows a lateral region 18, first zone 15 is preferably formed as a pair of patches positioned in the right and left lateral region 18 of the garment, each of which is localized along each side of a wearer's waistline and hip area, wrapping around from the anterior 14 to posterior region 16 to provide a waist and hip-slimming effect. Additionally, first zone 15 preferably adds support to a growing fetus and womb.

A second zone 20 of the garment 10 of the disclosure preferably forms the largest area of the garment 10 and is preferably the second most compressive portion of the garment. The second zone 20 is positioned to extend over a lower torso region 24. Lower torso region 24 is positioned to extend transversely around a wearer's buttocks and lower abdomen, and includes two extending leg portions 22 with openings for a wearer's legs. The second zone 20 preferably comprises an elastic stretchable material of moderate compression to a wearer for gently shaping and contouring a lower torso including hips and buttocks of a wearer. The added compression in this zone 20 preferably also helps stimulate blood circulation. The second zone 20 also preferably extends from the lower torso region 24 along each of the lateral sides 18 to the anterior side of a shoulder region 26, and is attached in the shoulder region 26 to a non-stretchable zone 30. In cooperation with the non-stretchable zone 30, as described below, second zone 20 preferably provides extra support for the back and spine of a wearer.

Referring to FIGS. 2 and 3, a third zone 30 preferably connects between an upper edge 32 of second zone 20 located in the shoulder region 26 and an upper posterior edge 34 of second zone 20 in the posterior region of the lower torso region 24. The third zone 30 includes a non-stretchable material. Although non-stretchable zone 30 can be a unitary panel, as shown in FIG. 2, zone 30 preferably includes a central panel 36 and two laterally positioned panels 38 extending outwardly and upwardly from an upper portion of central panel 36. Central panel 36 preferably extends from the upper edge 34 of the posterior lower torso region to the upper edge of garment 10.

In a preferred embodiment, the panels of non-stretchable zone 30 include NEURO-BANDS®, which can be sewn on top of a light-weight elastic material forming at least part of a liner of the garment 10, or can be a single-layer structure integrated with adjacent zones by stitching or blending or other suitable methods including seamless construction methods. In one embodiment, at least a portion of non-stretchable zone 30 includes an inner skin-contacting surface that stimulates nerve endings that cue the muscles into a neutral posture. In certain embodiments, the inner skin-contacting surface includes soft, tacky, bumps or cutaneous nerve receptor stimulators, or viscoelastic pads, or other structures that can stimulate nerves and muscles into maintaining proper posture and/or provide a massaging, soothing effect.

Referring to FIGS. 2 and 3, a fourth zone 40 extends laterally upward and outward from each side of a lower portion of the central panel 36 to the shoulder region 26, preferably to a region above, or on the anterior side of, each armhole 42 of the garment 10, and wrapping around the posterior side of each armhole and to the axilla of a wearer. The fourth zone 40 preferably includes an elasticized material and is positioned to extend substantially along a wearer's latissimus dorsi muscle, the broadest muscle of the back that wraps up around the sides of the body and under the arms and which inter alia facilitates extension and lateral flexion of the lower spine. Fourth zone 40 is anchored to the non-stretchable central panel 36 and lateral panels 38, either by stitching or by integrating the adjacent zones according to known methods. Accordingly, fourth zone 40 can provide firm, elastic support for the neck and shoulders and cooperates with third zone 30 to help maintain proper alignment, posture, and support for a wearer while conducting normal arm, shoulder, and back movements in one's daily routine.

Because fourth zone 40 needs to stretch with the large muscle of the back to allow for normal activity, preferably zone 40 is a slightly lighter, less compressive, elastomeric material, or of a thinner elastomeric material, than that of adjacent second zone 20. Preferably, fourth zone 40 is positioned and adapted in cooperation with non-stretchable zone 30 to provide added support along the latissimus dorsi muscle. This is also preferably conducive to counteracting the forward pull and induced curvature of the spine caused by the added weight of a fetus developing in the womb of a pregnant woman wearing the garment. Accordingly, fourth zone 40 can advantageously help to stabilize a wearer's lower back and neutralize the spine.

Referring to FIGS. 1 and 3, a fifth zone or abdominal zone 50 is positioned to extend over a pregnant woman's expanding abdominal region to accommodate the expanding uterus as a fetus grows to term. Abdominal zone 50 preferably includes the most expandable, thinnest elastomeric layer of the garment 10, to allow for ultimate expansion to stretch as far as necessary throughout pregnancy. The material is preferably formed as a single layer with an inner skin-contacting layer. Preferably, the material includes a copper-infused fabric with antibacterial, odor-controlling and skin tone-enhancing properties to keep the skin toned and healthy during pregnancy and to provide good hygiene.

Referring to FIGS. 1-3, the garment 10 can also include bands 60 that form a terminating border of garment 10 around the legs. In the embodiment shown in FIGS. 1-3, the garment 10 ends at mid-thigh of a wearer. Bands 60 can be formed of any material that can resist sliding from its original position, preferably helping to anchor the garment 10 in place and preventing it from losing its shape and supportive characteristics. For example, in certain embodiments, the material can be a material that is non-stretchable at least along one (longitudinal) direction, or a heavy elastic material.

The garments of the present invention can be fabricated with a form-fitting material which forms an inner layer which may be positioned in contact with a wearer's skin. The form-fitting material can be an elastomeric material which is also breathable. The form-fitting material can also have moisture-wicking capability and can additionally include antimicrobials and/or odor neutralizers. For example, in certain embodiments, the form-fitting material includes any one or a blend of two or more of LYCRA®, SPANDEX®, and cotton. For example, the form-fitting material can be a cotton/LYCRA® blend, and may also be composed of fiber infused with copper or other skin tone-enhancing and odor-controlling hygienic elements.

The form-fitting material can be formed in various thicknesses and/or from various materials for imposing different levels of compression on a wearer. Any of the zones described above, including first zone 15, second zone 20, fourth zone 40, and fifth zone 50, and bands 60 which are comprised of a stretchable or elastic material, therefore, can be formulated as a single layer of form-fitting or other material of appropriate thickness and composition to achieve the desired level of compression and can be joined together by stitching or other means, including by seamlessly blending adjacent zones together in accordance with known methods. Alternatively, to achieve relative levels of compression, a higher compression zone can be formed by overlaying a heavier, thicker elastomeric material over a lighter inner elastomeric form-fitting material, including cotton/LYCRA® blends, which may also include copper and/or other skin tone enhancing and/or antimicrobial, odor-controlling elements, by stitching, welding or other known methods.

Similarly, zone 30, including panels 36, 38, which includes non-stretchable materials can be formed as a two-layer structure by overlaying the non-stretchable material, such as NEURO-BANDS®, by stitching or other known methods onto an inner layer suitable for contacting a wearer's skin or as a single-layer attached to adjacent zones by stitching welding, seamless construction methods or by other known methods. NEURO-BANDS® are formed of a base material that has a specific four way stretch material, containing a combination of Nylon, Polyester, and Lycra. Sewn into this 4-way stretch material are strategically placed strips of non-stretch material called Neuro-bands. In one embodiment of a garment of the present disclosure, the Neuro-bands are sewn in place on top of the garment 10 and form-fitting material or body shaper fabric, to connect with nerve endings on the back and shoulders and automatically cue the muscles of a pregnant woman into neutral anatomy (proper posture).

Figure 4:
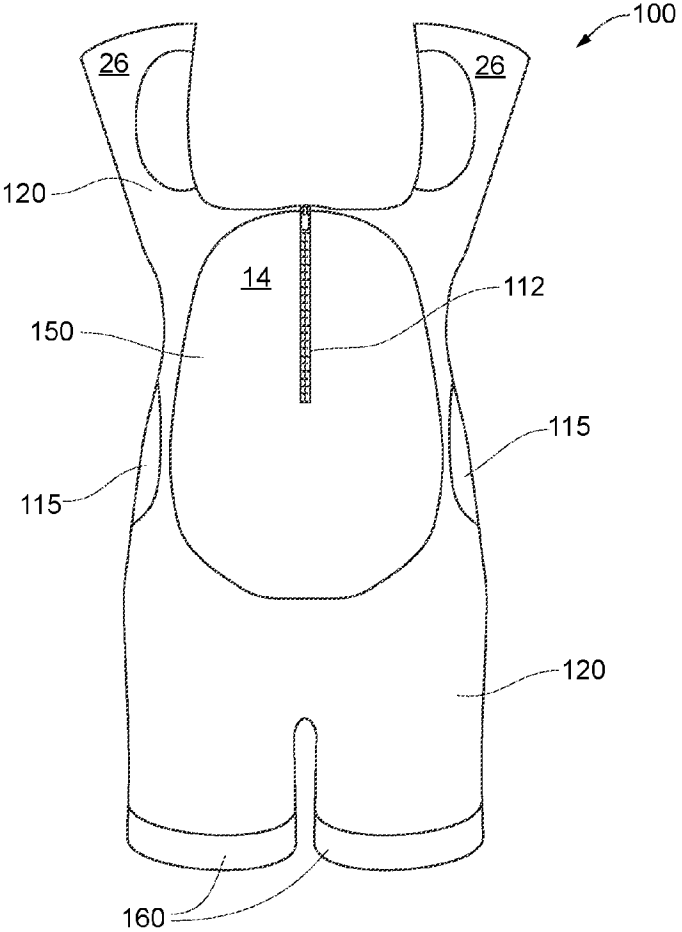
FIG. 4 is a front view of another embodiment of a garment of the present disclosure.
Figure 5:
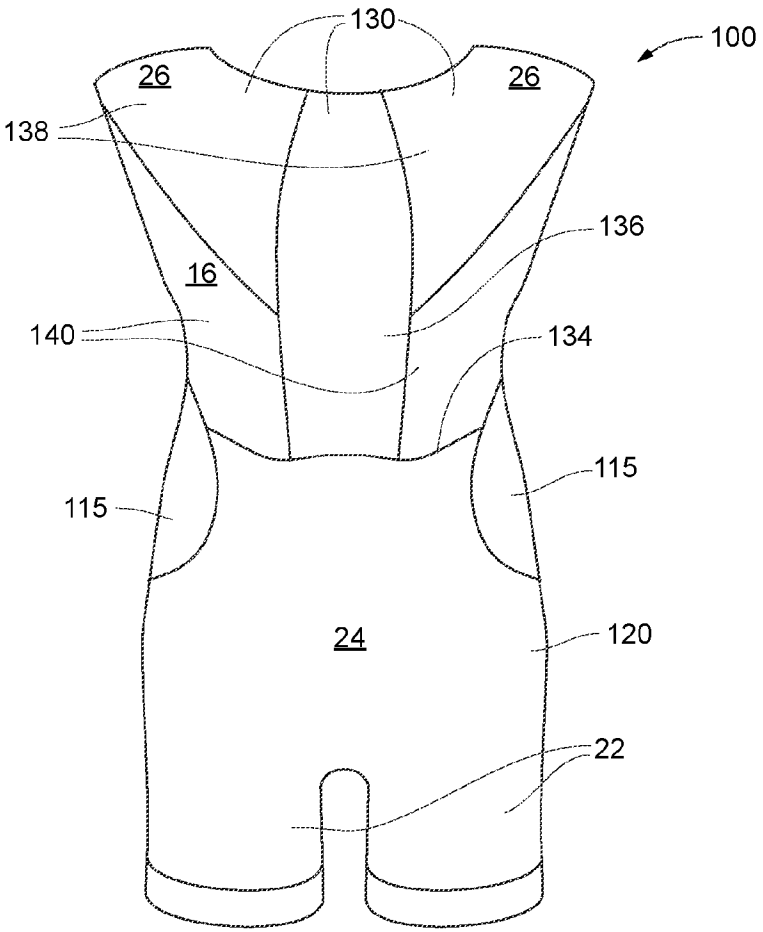
FIG. 5 is a rear view of the garment shown in FIG. 4.
Figure 6:
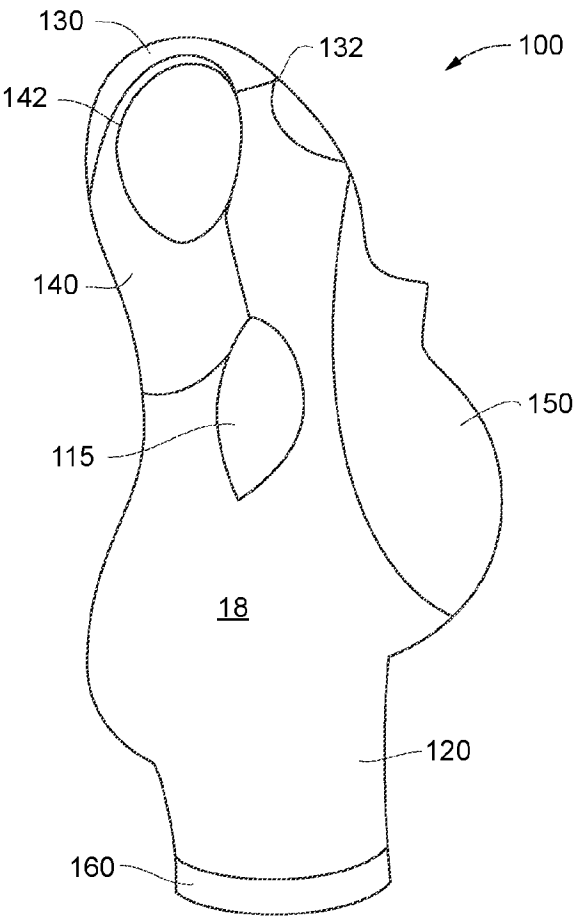
FIG. 6 is a side view of the garment shown in FIG. 4.

Referring to FIGS. 4-6, the present disclosure also relates to a garment 100 similar in structure to the bodysuit shown in FIGS. 1-3 and that offers the same supportive, posture-enhancing and skin toning benefits of the garment 10 described above, but with additional compressive and slimming features. In one embodiment, garment 100 is adapted for use as a post-maternity garment for aiding a new mother wearing the garment 100 to regain her natural shape. The benefits to a wearer also preferably include promotion of more efficient breathing, increased energy, and good balance, and providing a longer and leaner appearance. As described further herein, the garment 100 is preferably formed of a form-fitting material that includes NILIT® microfibers at least in the portions of the garment covering a wearer's abdomen, hips and thighs for its beneficial effect on reduction of cellulite.

Referring to FIGS. 4-6, one embodiment 100 of a garment of the present disclosure includes multiple zones functionally designed and strategically positioned on a new mother's body to induce a neutral posture and support for months after giving birth. The different zones can have different levels and directions of stretch, compression, and/or nerve stimulation.

The embodiment 100 shown is a mid-thigh tank design extending from the neck and shoulders to the mid-thigh of a wearer, and covering the breasts and abdomen of a wearer. Referring to FIG. 4, a zipper 112 can be included for ease in donning and removing the garment, preferably in an anterior region 14, or front, of the garment and extending at least from a middle of a wearer's abdomen to a top edge of the garment. One of skill in the art will appreciate that numerous variations of the design of embodiment 100 are possible without departing from the scope of the present invention. For example, in particular embodiments for use as a post-maternity garment, garment 100 can include pockets and so on to access the areolae for ease in nursing.

The garment 100 preferably includes a first zone 115 that provides a high level of compression in the waist area of a wearer's body. In one embodiment, first zone 115 is adapted to provide the greatest compression to a wearer than any other area of the garment 100. Referring also to FIG. 5, which shows a posterior region 16 of the garment, and to FIG. 6, which shows a lateral region 18, first zone 115 is preferably formed as a pair of patches positioned in the right and left lateral region 18 of the garment, each of which is localized along each side of a wearer's waistline and hip area, wrapping around from the anterior 14 to posterior region 16 to provide a waist and hip-slimming effect.

A second zone 120 of the garment 100 of the disclosure preferably forms the largest area of the garment 100 and is preferably the second most compressive portion of the garment. The second zone 120 is positioned to extend over a lower torso region 24. Lower torso region 24 is positioned to extend transversely around a wearer's buttocks and lower abdomen, and includes two extending leg portions 22 with openings for a wearer's legs. The second zone 120 preferably comprises an elastic stretchable material of moderate compression to a wearer for gently shaping and contouring a lower torso including hips and buttocks of a wearer. The added compression in this zone 120 preferably also helps stimulate blood circulation. The second zone 120 also preferably extends from the lower torso region 24 along each of the lateral sides 18 to the anterior side of a shoulder region 26, and is attached in the shoulder region 26 to a non-stretchable zone 130. In cooperation with the non-stretchable zone 130, as described below, second zone 120 preferably provides extra support for the back and spine of a wearer.

Referring to FIGS. 5 and 6, a third zone 130 preferably connects between an upper edge 132 of second zone 120 located in the shoulder region 26 and an upper posterior edge 134 of second zone 120 in the posterior region of the lower torso region 24. The third zone 130 includes a non-stretchable material. Although non-stretchable zone 130 can be a unitary panel, as shown in FIG. 5, zone 130 preferably includes a central panel 136 and two laterally positioned panels 138 extending outwardly and upwardly from an upper portion of central panel 136. Central panel 136 preferably extends from the upper edge 134 of the posterior lower torso region to the upper edge of garment 100.

In a preferred embodiment, the panels of non-stretchable zone 130 include NEURO-BANDS®, which can be sewn on top of a light-weight elastic material forming at least part of a liner of the garment 100, or can be a single-layer structure integrated with adjacent zones by stitching or blending or other suitable methods including seamless construction methods. In one embodiment, at least a portion of non-stretchable zone 130 includes an inner skin-contacting surface that stimulates nerve endings that cue the muscles into a neutral posture. In certain embodiments, the inner skin-contacting surface includes soft, tacky, bumps or cutaneous nerve receptor stimulators, or viscoelastic pads, or other structures that can stimulate nerves and muscles into maintaining proper posture and/or provide a massaging, soothing effect.

Referring to FIGS. 5 and 6, a fourth zone 140 extends laterally upward and outward from each side of a lower portion of the central panel 136 to the shoulder region 26, preferably to a region above, or on the anterior side of, each armhole 142 of the garment 100, and wrapping around the posterior side of each armhole and to the axilla of a wearer. The fourth zone 140 preferably includes an elasticized material and is positioned to extend substantially along a wearer's latissimus dorsi muscle, the broadest muscle of the back that wraps up around the sides of the body and under the arms and which inter alia facilitates extension and lateral flexion of the lower spine. Fourth zone 140 is anchored to the non-stretchable central panel 136 and lateral panels 138, either by stitching or by integrating the adjacent zones according to known methods. Accordingly, fourth zone 140 can provide firm, elastic support for the neck and shoulders and cooperates with third zone 130 to help maintain proper alignment, posture, and support for a wearer while conducting normal arm, shoulder, and back movements throughout the wearer's daily routine.

Because fourth zone 140 needs to stretch with the large muscle of the back to allow for normal activity, preferably zone 140 is a slightly lighter, less compressive, elastomeric material, or of a thinner elastomeric material, than that of adjacent second zone 120. Preferably, fourth zone 140 is positioned and adapted in cooperation with non-stretchable zone 130 to provide added support along the latissimus dorsi muscle. This is preferably also conducive to counteracting the forward pull and induced curvature of the spine caused by the additional abdominal weight and swollen breasts of a new mother wearing the garment during the post-partum months. Accordingly, fourth zone 140 can advantageously help to stabilize a wearer's lower back and neutralize the spine.

Referring to FIGS. 4 and 6, a fifth zone or abdominal zone 150 is positioned to extend over a wearer's abdominal region. In the particular embodiment shown, zone 150 is preferably positioned to extend over a post-partum woman's shrinking abdominal region. Abdominal zone 150 is preferably the most compressive zone, along with first zone 115, to help shrink abdominal weight, including the abdominal fat left over after giving birth. The abdominal zone 150 can be formed as a single thick elastomeric layer with an inner skin-contacting surface, or as a multi-layer structure with an inner skin-contacting form-fitting layer and upper heavier elastomeric layer (s) attached for compression. Preferably, the material forming the skin-contacting surface of the abdominal zone 150, as well as that of the compressive first zone 115 and second zone 120, includes cellulite-reduction fibers. In a preferred embodiment, the skin-contacting layers of at least these three compressive zones include NILIT® Innergy, a nylon 6.6 fiber that preferably has a built-in, naturally occurring mineral additive that creates far infrared ray (FIR) emissions, which can invigorate the body, increase feelings of well-being and help to reduce the appearance of cellulite for a more toned body.

Referring to FIGS. 4-6, the garment 100 can also include bands 160 that form a terminating border of garment 100 around the legs. In the embodiment shown, the garment 100 ends at mid-thigh of a wearer. Bands 160 can be formed of any material that can resist sliding from its original position, preferably helping to anchor the garment 100 in place and preventing it from losing its shape and supportive characteristics. For example, in certain embodiments, the bands 160 can include material that is non-stretchable at least along one (longitudinal) direction, or a heavy elastic material.

The garments of the present disclosure can be fabricated with a form-fitting material which forms an inner layer which may be positioned in contact with a wearer's skin. The form-fitting material can be an elastomeric material which is also breathable. The form-fitting material can also have moisture-wicking capability and can additionally include antimicrobials and/or odor neutralizers. For example, in certain embodiments, the form-fitting material includes any one or a blend of two or more of LYCRA®, SPANDEX®, and cotton. For example, the form-fitting material can be a cotton/LYCRA® blend, and, may also be composed of fiber infused with copper or other skin tone-enhancing elements and/or with cellulite-reducing fibers such as NILIT®.

The form-fitting material can be formed in various thicknesses and/or from various materials for imposing different levels of compression on a wearer. Any of the zones described above, including first zone 115, second zone 120, fourth zone 140, and fifth zone 150, and bands 160 which are comprised of a stretchable or elastic material, therefore, can be formulated as a single layer of form-fitting or other material of appropriate thickness and composition to achieve the desired level of compression and can be joined together by stitching or other means, including by seamlessly blending adjacent zones together in accordance with known methods. Alternatively, to achieve relative levels of compression, a higher compression zone can be formed by overlaying a heavier, thicker elastomeric material over a lighter inner elastomeric form-fitting material, including cotton/LYCRA® blends which preferably include NILIT®, by stitching, welding or other known methods.

Similarly, zone 130, including panels 136, 138, which includes non-stretchable materials can be formed as a two-layer structure by overlaying the non-stretchable material, such as NEURO-BANDS®, by stitching or other known methods onto an inner layer suitable for contacting a wearer's skin, including fabrics such as NILIT®, or as a single-layer attached to adjacent zones by stitching welding, seamless construction methods or by other known methods. NEURO-BANDS® are formed of a base material that has a specific four way stretch material, containing a combination of Nylon, Polyester, and Lycra. Sewn into this 4-way stretch material are strategically placed strips of non-stretch material called Neuro-bands. In one embodiment of a garment of the invention, the Neuro-bands are sewn in place on top of form-fitting body shaper fabric composed of NILIT® type fibers, to connect with nerve endings on the back and shoulders and automatically cue the muscles of a wearer, particularly, a post-partum woman, into neutral anatomy (proper posture).

In one embodiment of the garment of the present invention, the inner skin-contacting surface contains NLIT® microfibers throughout the garment, which preferably acts to convert thermo energy naturally produced by the body into Far Infrared Rays, reflects them back to the skin, and produces deep, gentle heating of the skin that reduces the appearance of cellulite. The combination of this inner skin-contacting surface with the compressive zones of the garment, preferably provide both compression to effectively slim and slenderize, and skin-toning cellulite reduction over time.

It should be apparent to those skilled in the art that the described embodiments of the present invention provided herein are illustrative only and not limiting, having been presented by way of example only. As described herein, all features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto.

What is claimed is:

1. A garment comprising a structure adapted to cover a wearer's torso and at least an upper portion of a wearer's thighs, the garment comprising:

a posterior region for extending across a wearer's back, and an anterior region for covering a wearer's breasts and abdomen, a left and right lateral region bordering the anterior and posterior regions on a wearer's left and right side respectively, a shoulder region positioned to extend over each shoulder of a wearer and bordering two armholes for fitting a wearer's arms;

a posterior panel disposed in the posterior region, the posterior panel comprising a first non-stretchable material and positioned to extend transversely at least over an inter scapular upper back region of a wearer and longitudinally to at least a wearer's waistline;

an abdominal portion centrally disposed in the anterior region, the abdominal portion comprising a stretchable material having a level of compression different than that of a material disposed in the anterior region encircling the abdominal portion;

a shoulder support portion extending laterally and upwardly from a lower portion of the posterior panel to the shoulder region above each of the two armholes, the shoulder support portion also wrapping laterally around each of the left and right lateral region and extending under each axilla of a wearer;

a lower torso region extending transversely around a wearer's buttocks and lower abdomen; and a body support portion positioned to extend over the lower torso region and further extending along each of the left and right lateral sides to the shoulder region, the body support portion bordering and encircling the abdominal portion and comprising the material disposed in the anterior region encircling the abdominal portion, and wherein the posterior panel is operatively connected between an upper edge of the body support portion in the shoulder region and an upper edge of the body support portion in the posterior region.

2. The garment of claim 1, further comprising:

two patches formed of a compressive material positioned in the left and right lateral region along a left and right side of a wearer's waist.

3. The garment of claim 1, the posterior panel comprising a central posterior panel and a pair of posterior lateral panels disposed in the posterior region, each of the pair extending laterally and upwardly from an upper portion of the central posterior panel to the shoulder region above each of the two armholes, the pair of posterior lateral panels disposed superior to the shoulder support portion;

wherein the pair of posterior lateral panels comprise a second non-stretchable material.

4. The garment of claim 3, wherein the first and second non-stretchable material are the same material.

5. The garment of claim 2, wherein each of the two patches is substantially oval shaped and has a maximum width, and wherein each of the two patches extends longitudinally a length proximate an inferior edge of a wearer's ribcage downward to a wearer's hip, wherein the length is equal to or greater than twice the maximum width.

6. The garment of claim 1, wherein the lower torso region includes two extending leg portions with openings for a wearer's legs.

7. The garment of claim 1, wherein the level of compression of the stretchable material of the abdominal portion is less than that of the material disposed in the anterior region encircling the abdominal portion.

8. The garment of claim 6, further comprising:

a band around a lower perimeter of each of the two extending leg portions for anchoring the body support portion.

9. The garment of claim 6, wherein the body support portion is more compressive and resistant to stretching than the shoulder support portion, wherein the stretchable material of the abdominal portion is less resistant to stretching and less compressive than the material of the body support portion and of the shoulder support portion.

10. The garment of claim 9, further comprising two patches formed of a compressive material positioned in the left and right lateral region along a left and right side of a wearer's waist, the compressive material being more compressive than the body support portion.

11. The garment of claim 1, wherein the level of compression of the stretchable material of the abdominal portion is higher than that of the material disposed in the anterior region encircling the abdominal portion.

12. The garment of claim 6, further comprising two patches formed of a compressive material positioned in the left and right lateral region along a left and right side of a wearer's waist, wherein the level of compression of the stretchable material of the abdominal portion and of the compressive material are greater than that of the body support portion, and wherein the body support portion is more compressive and resistant to stretching than the shoulder support portion.

13. The garment of claim 11, wherein the stretchable material of the abdominal portion includes an inner surface for contacting a wearer's skin comprising nylon fibers.

14. The garment of claim 6, wherein at least a portion of the garment comprises an inner surface for contacting a wearer's skin comprising at least one of a skin-toning, antimicrobial, and odor-reducing agent.

15. The garment of claim 1, wherein the material of the body support portion includes an inner surface for contacting a wearer's skin comprising nylon fibers.

16. The garment of claim 12, wherein at least one of the compressive material of the patches and the material of the body support portion includes an inner surface for contacting a wearer's skin comprising nylon fibers.

* * * * *